US009474429B2

(12) United States Patent
Kepner et al.

(10) Patent No.: US 9,474,429 B2
(45) **Date of Patent: *Oct. 25, 2016**

(54) CLEAN WATER MOPPING SYSTEM

(71) Applicant: Rubbermaid Commercial Products, LLC, Winchester, VA (US)

(72) Inventors: Matthew Scott Kepner, Stephens City, VA (US); Frank Wang, Stephenson, VA (US); Kevin Fitzpatrick, Winchester, VA (US); Kim Chow, Pasadena, CA (US)

(73) Assignee: Rubbermaid Commercial Products, LLC, Winchester, VA (US)

( * ) Notice: Subject to any disclaimer, the term of this patent is extended or adjusted under 35 U.S.C. 154(b) by 46 days.

This patent is subject to a terminal disclaimer.

(21) Appl. No.: 14/208,880

(22) Filed: Mar. 13, 2014

(65) Prior Publication Data

US 2014/0263104 A1 Sep. 18, 2014

Related U.S. Application Data

(60) Provisional application No. 61/787,521, filed on Mar. 15, 2013.

(51) Int. Cl.

| | |
|---|---|
| ***A47L 13/58*** | (2006.01) |
| *A47L 11/40* | (2006.01) |
| *A47L 13/20* | (2006.01) |

(52) U.S. Cl.

CPC ..... *A47L 13/58* (2013.01); *A47L 11/4022* (2013.01); *A47L 11/4025* (2013.01); *A47L 11/4027* (2013.01); *A47L 13/20* (2013.01)

(58) Field of Classification Search

None

See application file for complete search history.

(56) References Cited

U.S. PATENT DOCUMENTS

| | | | |
|---|---|---|---|
| 750,354 | A | 1/1904 | Fowler et al. |
| 790,030 | A | 5/1905 | Crawford |
| 2,255,091 | A | 9/1941 | Vaughn |
| 2,290,217 | A | 7/1942 | Trindl |
| 2,538,336 | A | 1/1951 | Smith |
| 2,623,230 | A | 12/1952 | Feinen |
| 2,787,015 | A | 4/1957 | Flam |
| 2,794,997 | A | 6/1957 | Channel |

(Continued)

FOREIGN PATENT DOCUMENTS

| | | | |
|---|---|---|---|
| CA | 2215574 | C | 3/2004 |
| CN | 200971426 | Y | 11/2007 |

(Continued)

OTHER PUBLICATIONS

Rock6, Gravity Water filters and a folding bucket, Apr. 12, 2010, pp. 1-6.*

(Continued)

*Primary Examiner* — Bobby Ramdhanie
*Assistant Examiner* — Michael An
(74) *Attorney, Agent, or Firm* — Sutherland Asbill & Brennan LLP

(57) ABSTRACT

A filter bucket and a mop bucket movable between an upstanding use position and a drain position where, when the mop bucket is in the drain position, water in the mop bucket drains into the filter bucket. A fluid flow path connecting the filter bucket to the mop bucket such that water in the filter bucket will flow through the fluid flow path from the filter bucket to the mop bucket. A filter located in the fluid flow path.

20 Claims, 6 Drawing Sheets

(56) References Cited

U.S. PATENT DOCUMENTS 2,827,648 A 3/1958 Geisz
2,906,403 A 9/1959 Truax
3,003,643 A 10/1961 Thomas
3,045,252 A 7/1962 Sorrells
3,261,473 A 7/1966 Riede
3,367,505 A 2/1968 Bray
3,383,158 A 5/1968 Leland
3,441,973 A 5/1969 Turk
3,926,452 A 12/1975 Goines et al.
4,022,228 A 5/1977 Ropp et al.
4,032,457 A 6/1977 Matchett
4,052,316 A 10/1977 Berger et al.
D250,245 S 11/1978 Bebb
4,161,799 A 7/1979 Sorrells
4,174,977 A 11/1979 Shallenberg et al.
4,202,361 A 5/1980 Bills
4,439,884 A 4/1984 Giorni
4,494,267 A 1/1985 Fredley
4,680,826 A 7/1987 Schunter
D296,254 S 6/1988 Jaros et al.
4,798,307 A 1/1989 Evrard
4,815,160 A 3/1989 Smith, Jr.
4,821,358 A 4/1989 Wyckoff et al.
4,827,562 A 5/1989 Blase et al.
4,845,800 A 7/1989 Pederson et al.
4,877,527 A 10/1989 Brownell
4,888,847 A 12/1989 Montijo
4,912,804 A 4/1990 Pasbol
4,965,906 A 10/1990 Mauro
5,050,655 A 9/1991 Borenstein
5,081,735 A 1/1992 Wyatt et al.
5,175,904 A 1/1993 Pagani
5,228,716 A 7/1993 Dahl
D338,299 S 8/1993 Delmerico et al.
5,245,724 A 9/1993 Sacks
5,289,953 A 3/1994 McMillan, III et al.
5,314,623 A 5/1994 Heskett
5,404,610 A 4/1995 Coyer et al.
5,454,131 A 10/1995 Mackenzie
5,476,282 A 12/1995 Dahl
5,548,865 A 8/1996 Pagani
5,590,804 A 1/1997 Crum et al.
D381,150 S 7/1997 Berti
5,666,684 A 9/1997 Cussen
5,687,444 A 11/1997 Hakker
5,794,301 A 8/1998 Hietala
5,810,021 A 9/1998 Walker
5,819,357 A 10/1998 Gould
5,822,820 A 10/1998 Heisler
5,864,914 A 2/1999 Salmon
5,918,343 A 7/1999 Young
5,941,410 A 8/1999 Mangano
5,971,199 A 10/1999 Jackson et al.
6,000,094 A 12/1999 Young
6,006,397 A 12/1999 Williams et al.
6,026,530 A 2/2000 Camp, Jr.
6,098,239 A 8/2000 Vosbikian
6,119,298 A 9/2000 Kenmochi
6,279,195 B1 8/2001 Biggs
6,283,170 B1 9/2001 Robinson
6,296,261 B1 10/2001 deGoma
6,343,612 B1 2/2002 Dahl
6,352,111 B1 3/2002 Bode et al.
6,389,638 B1 5/2002 Dickinson et al.
6,422,396 B1 7/2002 Li et al.
6,457,203 B1 10/2002 Williams et al.
D465,890 S 11/2002 Rivera et al.
6,523,220 B1 * 2/2003 Lynn ..... A47L 13/59 15/228
6,540,168 B1 4/2003 Archer et al.
6,662,401 B2 12/2003 Zorzo
6,736,969 B2 5/2004 Milne
6,851,391 B1 2/2005 Mulich
6,962,660 B2 11/2005 Wybo
7,081,201 B2 7/2006 Bassett et al.
7,200,891 B1 4/2007 McCulloch et al.
7,207,342 B1 4/2007 Daniels
7,225,499 B1 6/2007 Duncan et al.
D549,414 S 8/2007 Van Landingham, Jr.
7,254,863 B1 8/2007 Morad
7,350,260 B2 4/2008 Papa
7,356,868 B1 4/2008 Herrmann
7,434,292 B2 10/2008 Ramirez Moreno
7,458,590 B2 12/2008 Vanderberg et al.
7,487,881 B2 2/2009 Watzke et al.
7,490,745 B1 2/2009 Robinson
7,497,448 B2 3/2009 Brown
7,607,191 B2 10/2009 Morris et al.
7,735,182 B2 6/2010 Morris et al.
8,042,215 B2 10/2011 Thibault
8,082,620 B2 12/2011 Hoyle et al.
8,122,561 B2 2/2012 Dingert et al.
D659,926 S 5/2012 Van Landingham, Jr. et al.
8,221,618 B2 7/2012 Murray et al.
D671,288 S 11/2012 Van Landingham, Jr. et al.
D672,107 S 12/2012 Van Landingham, Jr. et al.
D672,930 S 12/2012 Van Landingham, Jr. et al.
8,393,047 B2 3/2013 Van Landingham, Jr. et al.
8,505,147 B2 8/2013 Van Landingham, Jr. et al.
8,510,901 B2 8/2013 Matola
8,567,087 B2 10/2013 Matola
8,635,736 B2 1/2014 Matola
2002/0069472 A1 6/2002 Glass
2002/0092113 A1 7/2002 Cann
2002/0170132 A1 11/2002 Brent
2003/0178377 A1 9/2003 Larson
2003/0217423 A1 11/2003 Larsen
2004/0237243 A1 * 12/2004 Dahl ..... A47L 13/59 15/261
2005/0076465 A1 4/2005 Rousey
2005/0086760 A1 4/2005 Young
2005/0204503 A1 * 9/2005 Burns ..... A47L 13/59 15/261
2006/0049096 A1 3/2006 Bassett et al.
2006/0085939 A1 4/2006 Petner
2006/0151054 A1 7/2006 Deaton
2007/0006413 A1 1/2007 Lee
2007/0062860 A1 3/2007 McDowell
2007/0241049 A1 10/2007 Tytar
2007/0251876 A1 11/2007 Krogue et al.
2008/0023383 A1 1/2008 Sansalone
2008/0257384 A1 10/2008 Farrell
2008/0302715 A1 12/2008 Venville
2008/0308484 A1 12/2008 Deb et al.
2009/0025804 A1 1/2009 Caminiti
2009/0050578 A1 2/2009 Israel et al.
2009/0094769 A1 4/2009 Wilson
2009/0266766 A1 10/2009 Huang et al.
2011/0080660 A1 4/2011 Kerle
2011/0099745 A1 5/2011 Van Landingham, Jr. et al.
2011/0099837 A1 5/2011 Matola et al.
2011/0100395 A1 5/2011 Van Landingham, Jr. et al.
2011/0100929 A1 5/2011 Van Landingham, Jr. et al.
2011/0203613 A1 8/2011 Roberts
2011/0303589 A1 12/2011 Kuennen et al.
2012/0110774 A1 5/2012 Matola
2012/0110814 A1 5/2012 Matola et al.
2012/0241389 A1 9/2012 Van Landingham, Jr. et al.
2013/0146177 A1 6/2013 Van Landingham, Jr. et al.
2013/0305480 A1 11/2013 Matola
2013/0312211 A1 11/2013 Matola
2014/0263105 A1 9/2014 Kontorovich et al.

FOREIGN PATENT DOCUMENTS

DE 4403550 CI 9/1995
DE 19631617 A1 2/1997
EP 1516575 A2 3/2005
EP 1736091 B1 3/2010
GB 2260691 A 4/1993
JP H10-286208 A 10/1998
WO 0000077 A1 6/2000
WO 03065869 A1 8/2003
WO 2006002652 A1 1/2006

(56) References Cited

FOREIGN PATENT DOCUMENTS

| | | | |
|---|---|---|---|
| WO | 2006002654 | A1 | 1/2006 |
| WO | 2006094918 | A1 | 9/2006 |
| WO | 2008106780 | A1 | 9/2008 |

OTHER PUBLICATIONS

Water 4 Life Ministry, May 10, 2012, pp. 1-3.*
International Searching Authority, International Search Report issued for International Application No. PCT/US2010/054273, Dec. 28, 2010.
International Searching Authority, Written Opinion issued for International Application No. PCT/US2010/054273, Dec. 28, 2010.
International Searching Authority, International Search Report issued for International Application No. PCT/US2010/054283, Dec. 17, 2010.
International Searching Authority, Written Opinion issued for International Application No. PCT/US2010/054283, Dec. 17, 2010.
International Searching Authority, International Search Report issued for International Application No. PCT/US2010/054287, Dec. 28, 2010.
International Searching Authority, Written Opinion issued for International Application No. PCT/US2010/054287, Dec. 28, 2010.
International Searching Authority, International Search Report issued for International Application No. PCT/US2010/054293, Dec. 27, 2010.
International Searching Authority, Written Opinion issued for International Application No. PCT/US2010/054293, Dec. 27, 2010.
Rubbermaid Commercial Products, LLC et al., International Application No. PCT/US2010/054273, International Preliminary Report on Patentability and Written Opinion, May 10, 2012.
Rubbermaid Commercial Products, LLC et al., International Application No. PCT/US2010/054283, International Preliminary Report on Patentability and Written Opinion, May 10, 2012.
Rubbermaid Commercial Products, LLC et al., International Application No. PCT/US2010/054287, International Preliminary Report on Patentability and Written Opinion, May 10, 2012.
Rubbermaid Commercial Products, LLC et al., International Application No. PCT/US2010/054293, International Preliminary Report on Patentability and Written Opinion, May 10, 2012.
International Searching Authority, International Search Report issued for International Application No. PCT/ US2011/059565, Mar. 4, 2012.
International Searching Authority, Written Opinion issued for International Application No. PCT/US2011/059565, Mar. 4, 2012.
International Searching Authority, International Search Report issued for International Application No. PCT/ US2011/059572, Mar. 5, 2012.
International Searching Authority, Written Opinion issued for International Application No. PCT/US2011/059572, Mar. 5, 2012.
Rubbermaid Commercial Products, LLC, International Application No. PCT/US12/31393, International Search Report and Written Opinion, Jun. 14, 2012.
Rubbermaid Commercial Products, LLC, International Application No. PCT/US2014/027051, International Search Report and Written Opinion, Jul. 30, 2014.
Rubbermaid Commercial Products, LLC, International Search Report and Written Opinion issued for International application No. PCT/US2014/026996, Jul. 28, 2014.

* cited by examiner

CLEAN WATER MOPPING SYSTEM

This application claims benefit of priority under 35 U.S.C. §119(e) to the filing date of U.S. Provisional Application No. 61/787,521, as filed on Mar. 15, 2013, which is incorporated herein by reference in its entirety.

BACKGROUND

In a traditional mopping process, a traditional mop bucket is filled with clean water at a janitor's closet or other water source and is moved from a janitor's closet to the site to be cleaned. The user dips a dry mop into the water in the mop bucket and fully wets the mop. The user lifts the mop and sets it in the wringer and wrings some of the water out of the mop into the mop bucket. The user mops the floor with the wet mop to clean the floor until the mop becomes too dirty or too dry. The user then dips the mop into the water in the mop bucket to rinse the dirt out of the mop. The user places the mop in the wringer and wrings the water and dirt from the mop into the water in the mop bucket. This process may be repeated multiple times. The water in the mop bucket becomes increasingly dirty as the process is repeated. When the dirty water is reintroduced to the floor via the mop, it is likely to redeposit some amount of dirt onto the floor. From this point on, until the mop bucket is dumped and rinsed and fresh water is added, the water continues to get dirtier. The only option for clean water is for the user to return the mop bucket to the janitor's closet or other water source, dump out the dirty water and refill the bucket with clean water including additional chemical cleaning agents. Such a process is labor and time intensive.

SUMMARY OF THE INVENTION

In some embodiments, a mopping system comprises a filter bucket. A mop bucket is movable between an upstanding use position and a drain position where, when the mop bucket is in the drain position, water in the mop bucket drains into the filter bucket. A fluid flow path connects the filter bucket to the mop bucket such that water in the filter bucket will flow through the fluid flow path from the filter bucket to the mop bucket. A filter is located in the fluid flow path.

The mop bucket may be tilted from the use position to the drain position. A mop wringer may be mounted such that the wringer drains into at least one of the mop bucket and the filter bucket. A mop wringer may be mounted such that the wringer drains into the filter bucket. A portion of the mop bucket may be moved vertically between the use position and the drain position. In the drain position a bottom of the mop bucket may be positioned vertically above the filter bucket. A lift system may be operatively connected to the mop bucket to move the mop bucket between the use position and the drain position. The lift system may comprise a hinge rotatably mounting the mop bucket and a handle operatively connected to the mop bucket to move the mop bucket between the use position and the drain position. The handle may be operatively connected to the mop bucket by a hinge. The handle may be movable relative to the mop bucket between a use position and a storage position. The mop bucket and filter bucket may be supported on wheels.

In some embodiments a mopping system comprises a filter bucket. A mop bucket is rotatable relative to the filter bucket between a use position where the mop bucket is positioned in an upright position and a drain position where the mop bucket is in a tilted position relative to the upright position such that water may flow from the mop bucket to the filter bucket. A fluid flow path connects the filter bucket to the mop bucket such that the water may flow from the filter bucket to the mop bucket along the fluid flow path. A filter is located in the fluid flow path such that water flows through the fluid flow path and the filter.

The fluid flow path may comprise a drain connecting the filter bucket to the mop bucket. The fluid flow path may comprise a reservoir disposed between the filter bucket and the mop bucket. A valve may control the flow of water from the reservoir to the mop bucket. A mop wringer may be mounted such that the outlet of the wringer drains into at least one of the mop bucket and the filter bucket. A mop wringer may be mounted such that the wringer drains into the filter bucket. A lift system may be operatively connected to the mop bucket to move the mop bucket between the use position and the drain position. The lift system may comprise a handle operatively connected to the mop bucket and a hinge rotatably supporting the mop bucket.

In some embodiments a method of operating a mopping system comprises a filter bucket; a mop bucket movable between an upstanding use position and a tilted drain position; a fluid flow path connecting the filter bucket to the mop bucket such that water in the filter bucket drains through the fluid flow path from the filter bucket to the mop bucket; and a filter located in the fluid flow path is provided. The method comprises tilting the mop bucket to the drain position such that the dirty water drains from the mop bucket into the filter bucket; rotating the mop bucket back to the upright use position; allowing the dirty water to flow along the fluid flow path through the filter and to the mop bucket. In the method the filter may be removed and either cleaned or replaced.

DETAILED DESCRIPTION OF EMBODIMENTS OF THE INVENTION

Figure 1:
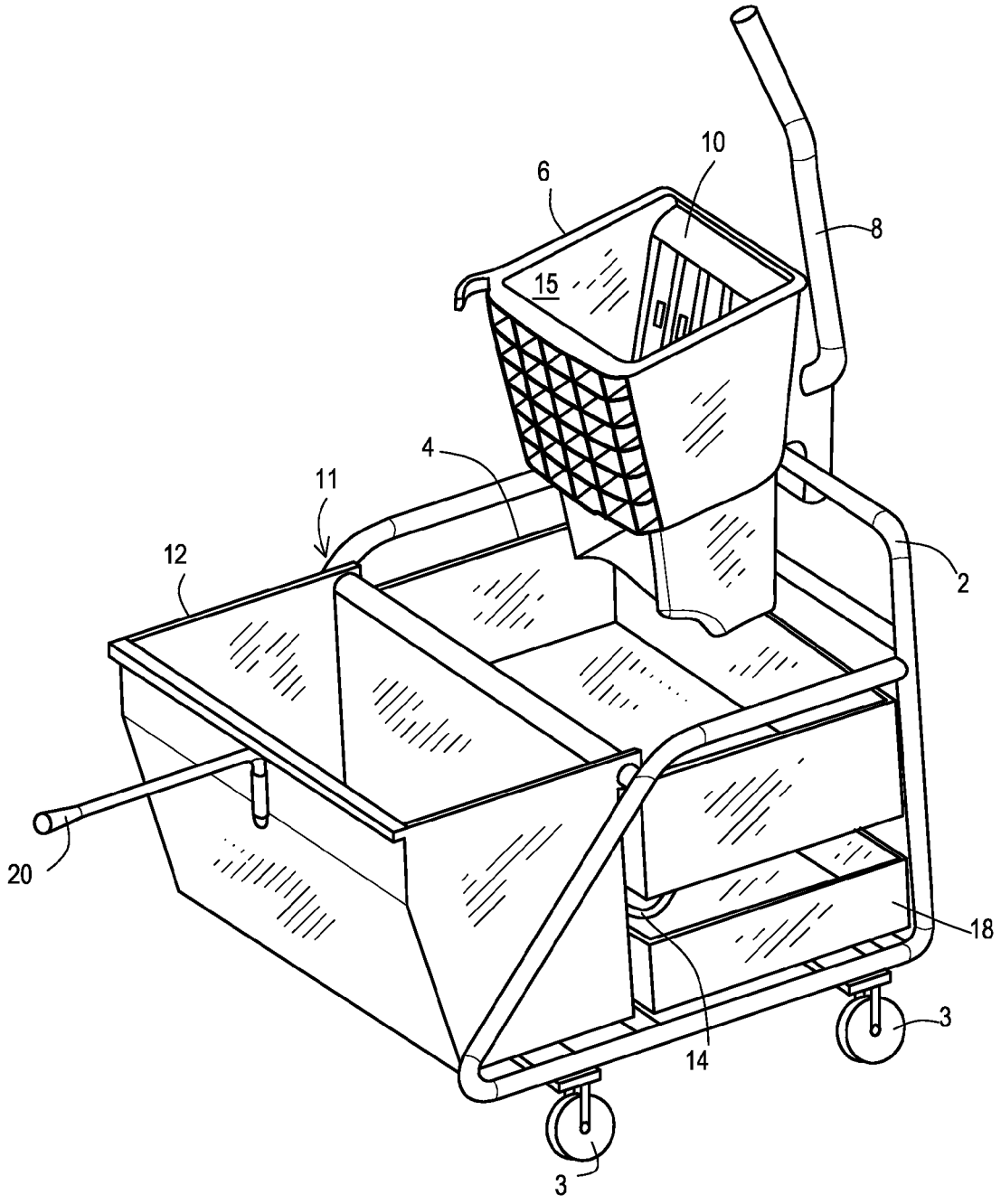
FIG. 1 is a perspective view of an embodiment of the clean water mopping system of the invention.

Embodiments of the invention provide a mopping system that provides clean water to the end user at the cleaning site without requiring that the mop bucket be transported to a janitor's closet or other water source to drain and refill the mop bucket. "Water" as used herein means any cleaning solution, cleaning fluid, water, water mixed with a cleaning agent, a cleaning agent other than water or any other liquid that may be advantageously used as a cleaning agent and that may be cleaned using the system of the invention. "Janitor's closet" as used herein means any source of fresh water, cleaning solution and/or a drain where a mop bucket is traditionally, emptied, cleaned and refilled and is not limited to an actual janitor's closet.

In order to wash floors properly, it is necessary to use water that contains little or no dirt, particulate matter or the like (the term "dirt" is used herein to refer to any unwanted particulates in the water). Because providing clean water in a traditional system is labor and time intensive, the user of a traditional system typically uses water that is dirty when cleaning a dirty floor surface. Without replacing the water, the floor is cleaned with increasingly dirty water creating issues with dirt presence on the floors, streaking, cross contamination from different zones, and basic hygiene.

Embodiments of the present invention relate to a mopping system that removes the dirt from the water and provides clean water without the need to return to the janitor's closet and/or drain and refill the water. The system of the invention saves time and labor and uses fewer resources and minimizes the use and disposal of chemical cleaning solutions.

In some embodiments the clean water mopping system of the invention may comprise a frame 2 for supporting the components of the system. The frame 2 may comprise a metal frame made of, for example, tubular metal members or the frame may comprise a molded plastic frame. The materials and construction of the frame 2 may vary from that disclosed herein provided that the frame can adequately support the system components. In one embodiment the frame 2 may be mounted on rollers, casters, wheels (hereinafter "wheels") 3 or other similar devices to allow a user to push the system over a floor or other surface. In one embodiment two fixed wheels and two pivoting wheels may be used to prevent the frame from "crabbing" as it is pushed or pulled. In some embodiments the components of the system may be mounted to one another rather than being individually mounted on a separate frame 2.

In one embodiment, the frame 2 supports a filter bucket 4 that is mounted in a fixed position on the frame 2. The term "bucket" is used to refer to any container, compartment or receptacle that may be used to contain water in the mopping system. While the filter bucket 4 is mounted in a fixed position on the frame it may be made removable for service, cleaning, replacement or the like.

A mop wringer 6 is mounted on one end of the filter bucket 4 such that when a mop is wrung in the wringer 6 the water from the mop drains into the filter bucket 4. While in the illustrated embodiment the wringer 6 is mounted on the frame 2, the wringer 6 may be mounted in other manners and locations, such as directly on filter bucket 4, provided that the water can drain from the wringer 6 to the filter bucket 4. In some embodiments the wringer 6 may be positioned to drain into the mop bucket 12 rather than into the filter bucket 4. The wringer 6 may comprise a wringer that is suitable for use with a flat mop or a wringer that is suitable for use with a string mop where the different types of mops may require wringers having different sizes, shapes, configurations or the like. The buckets used in the cleaning system may also be sized and shaped or otherwise configured to accommodate string mops, flat mops or other styles of mops. The wringer 6 may be removably mounted on the frame 2 or bucket 4 such that the wringer 6 may be removed and replaced, allowing any type of wringer to be used in the system of the invention. The wringer 6 may operate such as by depressing or rotating an actuating handle 8 to bring a wringer operator 10 such as a movable plate or plates, rollers or the like into engagement with the cleaning surface of the mop to squeeze the dirty water from the mop. In a typical mop wringer, the mop wringer comprises a compartment 15 for receiving the cleaning surface of the mop that supports the wringer operator 10 and actuating handle 8. The compartment 15 is configured to receive the mop such that the mop is disposed between the wringer operator and a wall of the compartment or between two cooperating wringer operators. When the actuating handle is rotated or otherwise moved, the wringer operator(s) squeeze the cleaning surface of the mop, such as strings or a pad, to squeeze water and dirt from the cleaning surface. The compartment 15 may be open at one end or it may be provided with openings such that water squeezed from the cleaning surface of the mop can drain from the wringer 6 to the filter bucket 4.

Figure 2:
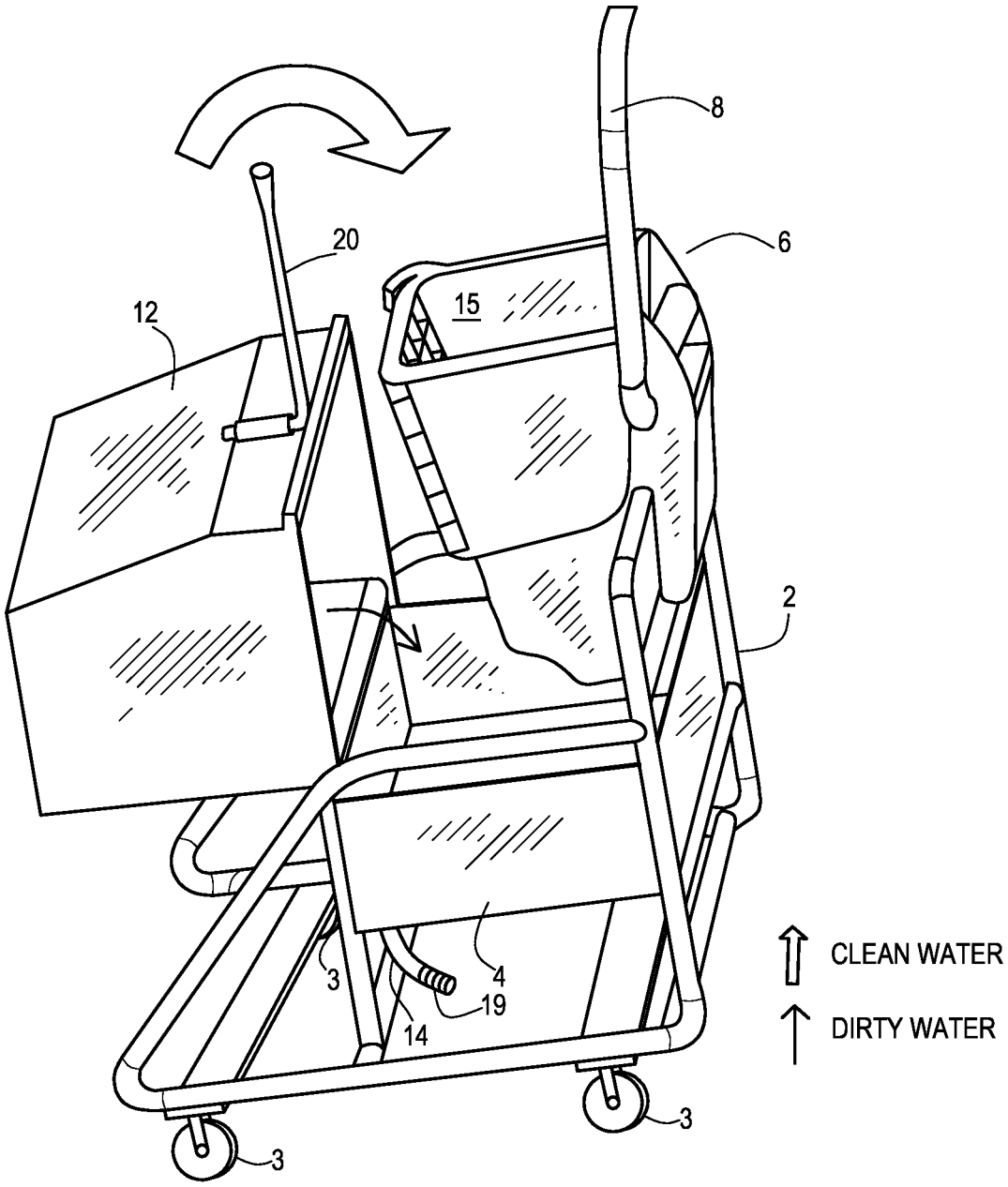
FIG. 2 is a perspective view of the clean water mopping system of FIG. 1 in a second position.

The mop bucket 12 is used by the user to wet the mop and to clean dirt from the mop during the mopping process. Thus, the mop bucket 12 is dimensioned and configured to receive the mop and to retain a sufficient amount of water to wet and clean the mop. In some embodiments, a mop bucket 12 is located adjacent the filter bucket 4 and is mounted on a lift system such that the mop bucket 12 may be tilted or otherwise moved from the upstanding use position (FIG. 1) to a drain position (FIG. 2). In the use position the mop bucket 12 is disposed in a upright position with the bottom of the bucket extending generally horizontally and the walls extending generally vertically to define an opening for receiving the mop. In one embodiment the lift system comprises a hinge 11 for pivotably mounting the mop bucket 12 to the frame 2 or filter bucket 4. The hinge 11 may comprise any suitable hinged joint, pivot points, axle or other mechanism. A handle 20 facilitates the tilting of the mop bucket 12 about hinge 11 and lessens the lifting force required to rotate the mop bucket 12. In one embodiment the handle 20 may rotate between a storage position where it is flush with the mop bucket 12 and a use position (shown in the drawings) where it extends from the bucket 12 where it may be grasped by a user. The handle may take other forms such as a molded feature in the sides or bottom of the mop bucket. The mop bucket 12 is positioned such that when the mop bucket 12 is in the drain position (FIG. 2) the mop bucket is tilted and the water in the mop bucket 12 drains into the filter bucket 4. While in the illustrated embodiment the mop bucket 12 is mounted adjacent to the filter bucket 4 such that the water drains directly from the mop bucket 12 into the filter bucket 4, the mop bucket 12 may be located in other positions provided water can drain from the mop bucket 12 to the filter bucket 4. For example, a conduit may be provided between the mop bucket 12 and the filter bucket 4 to deliver the water from the mop bucket 12 to the filter bucket 4.

Other lift systems may be used to raise and tilt the mop bucket 12 such as a lever, linkage, foot pedal, motorized lift system or the like. Moreover, in some embodiments the emptying of the mop bucket into the filter bucket may be accomplished by raising the mop bucket 12 relative to the filter bucket 4 and opening a valve or a spigot located near the bottom of the mop bucket 12 rather than by tilting the mop bucket 12. In other embodiments a pump such as a battery operated pump may be used to pump the water from the mop bucket 12 to the filter bucket 4.

In some embodiments the lift system relies on gravity to drain the water from the mop bucket 12 into the filter bucket 4. In some embodiments the mop bucket or a portion of the mop bucket is raised vertically, either by rotating the mop bucket 14 to tilt the mop bucket, or by moving the mop bucket 12 vertically such that the mop bucket 14 is above the filter bucket 2. In some embodiments the bottom of the filter bucket is moved above the top edge of the filter bucket 2 to fully drain the filter bucket 4. In some embodiments the mop bucket 14 is moved such that the bottom of the mop bucket 14 is disposed above the bottom of the filter bucket 2 such that water may fully drain from the mop bucket 14 into the filter bucket.

The filter bucket 4 is connected to the mop bucket 12 by a fluid flow path such as drain 14 such that water in the filter bucket 4 will drain by head pressure/gravity through the fluid flow path from the filter bucket 4 to the mop bucket 12. The drain 14 may comprise any suitable conduit, pipe, hose, passage or the like that allows the flow of water from the filter bucket 4 to the mop bucket 12. In one embodiment the bottom of the filter bucket is disposed above the bottom of the mop bucket 12 and the drain 14 is positioned at the bottom of the filter bucket 4 such that the filter bucket 4 may fully drain into the mop bucket 12. In some embodiments the output of the drain 14 is located such that a portion of the mop bucket 14 extends above the output of the drain 14. Because the mop bucket 12 tilts relative to the filter bucket 4 the drain 14 may comprise a length of flexible or expandable tubing or conduit that can accommodate the relative movement between the buckets. Alternatively, the drain 14 may be disconnected from the mop bucket 12 and/or filter bucket 4 to allow relative movement between the buckets from the mop bucket 12 and/or filter bucket 4. Quick connect couplers 19, such as self-sealing fittings, may be used to connect and disconnect the drain. Alternatively a valve or valves may be provided in the drain 14 to control the flow of water when the drain 14 is disconnected. The fluid flow path may comprise the drain 14, portions of the filter bucket 14 and the mop bucket 12 and/or other components such as fittings, valves, additional conduit or the like that are in the fluid flow path between the filter bucket 4 and the mop bucket 12.

Figure 3:
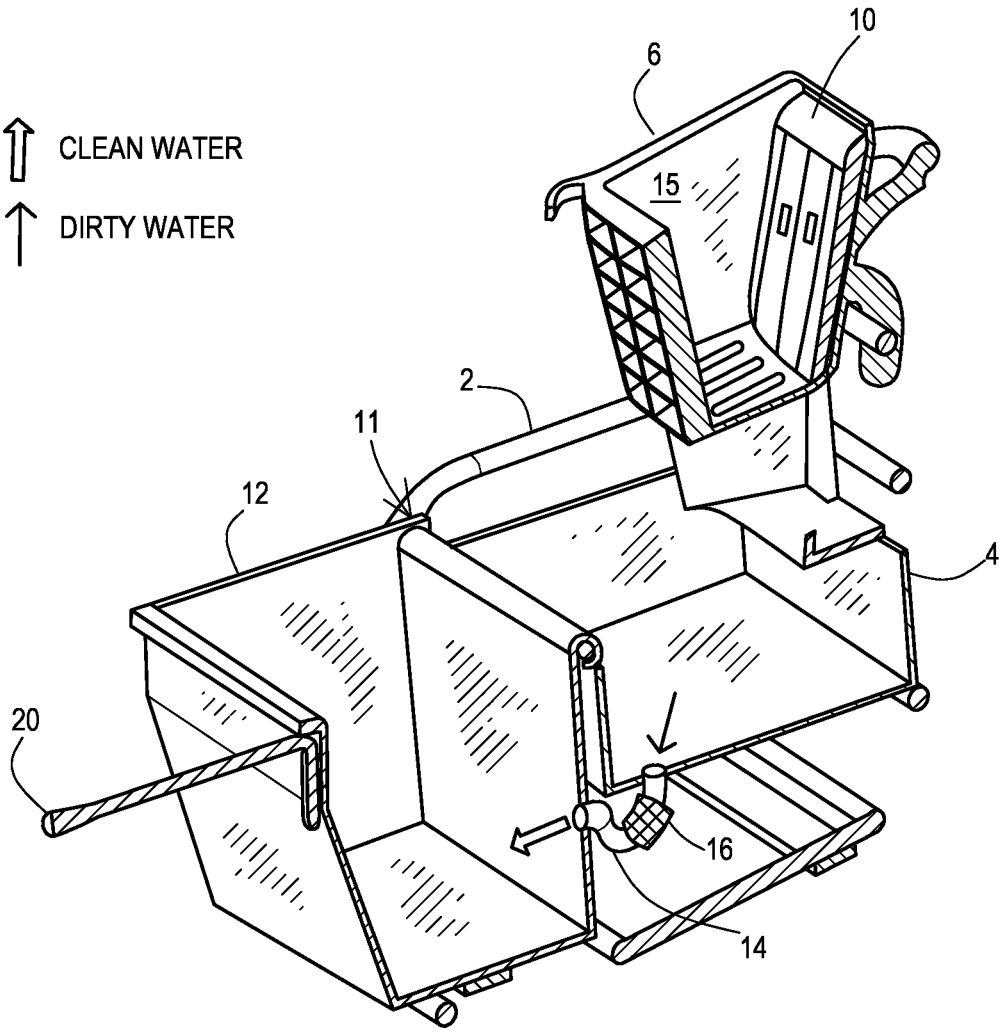
FIG. 3 is a perspective section view of the clean water mopping system of FIG. 1.
Figure 4:
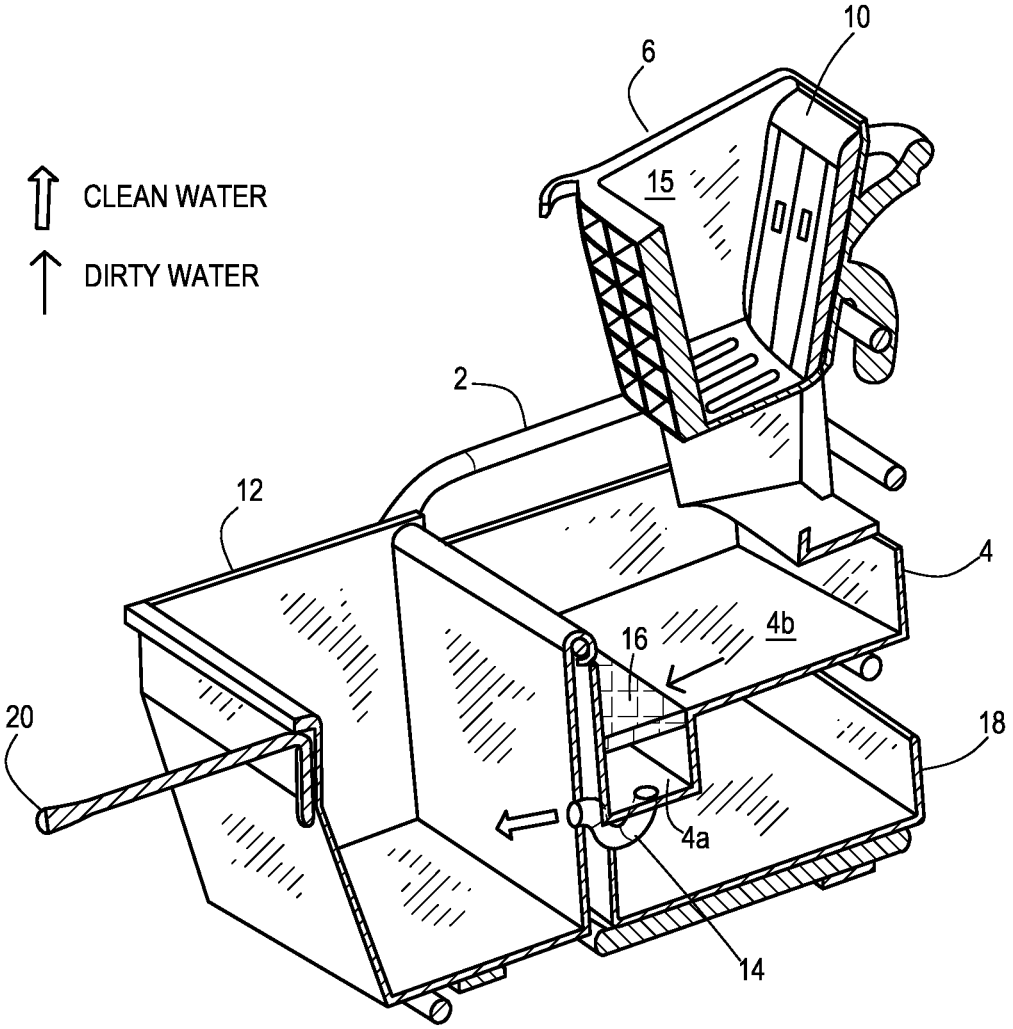
FIG. 4 is a perspective section view of another embodiment of the clean water mopping system of the invention.
Figure 5:
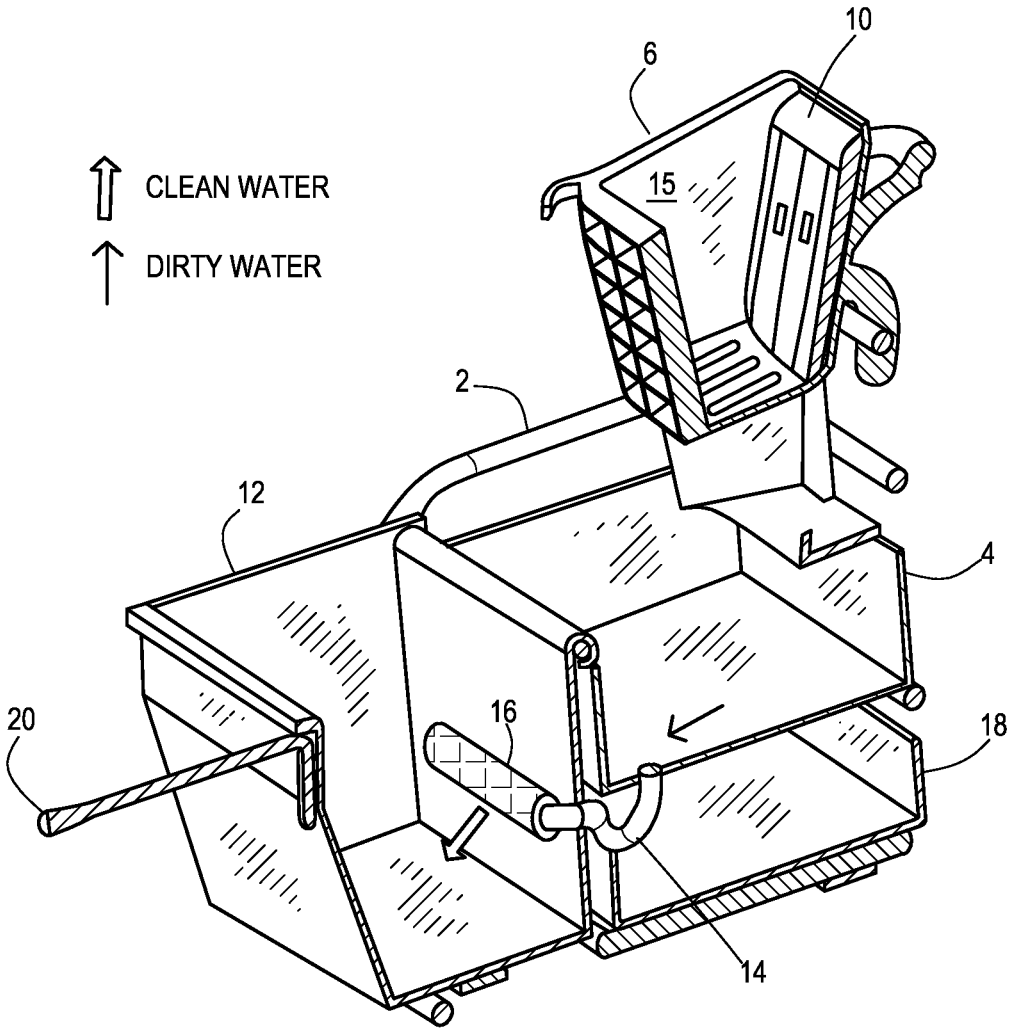
FIG. 5 is a perspective section view of yet another embodiment of the clean water mopping system of the invention.

A filter 16 is disposed in the fluid flow path between the filter bucket 4 and the mop bucket 12 such that water in the filter bucket 4 passes through the filter 16 as it flows between the filter bucket 4 and the mop bucket 12. The fluid flow path may comprise any structure through which water flows from the filter bucket 4 to the mop bucket 12 where the filter 16 may be located to filter dirt from the flowing water. The filter 16 filters out dirt from the water in the system to the extent necessary to provide water that is clean enough for cleaning purposes. The filter 16 may comprise any suitable construction and may be designed to provide any suitable degree of filtration. The filter 16 may extend across the entire filter bucket 4, as shown in FIG. 4, where a clean water reservoir 4*a* is disposed below a dirty water chamber 4*b* and the filter 16 is disposed between the dirty water chamber 4*b* and clean water reservoir 4*a*. Water flows between the dirty water chamber 4*b* and the clean water reservoir 4*a* through filter 16 where the clean water reservoir 4*a* and the filter 16 are in the fluid flow path. Alternatively, the filter 16 may be disposed over or in drain 14 as shown in FIG. 3. The filter 16 may also be located in the filter bucket 12 at the outlet of drain 14 to filter the water as it enters the mop bucket as shown in FIG. 5. The water must flow through the filter 16 before it is accessible to the user in mop bucket 12. Other arrangements of the filter 16 are possible provided the filter 16 is capable of filtering dirt from the water as it flows along the fluid flow path from the filter bucket 4 to the mop bucket 12.

A storage pan or tray 18 may be provided on the frame 2 for storing tools, cleaning implements or other supplies. The storage pan or tray 18 may have a variety of configurations including a closable compartment and may be removably mounted on the frame. While the storage pan or tray 18 is shown mounted below the filter bucket 4 it may be located elsewhere on the frame 2. The storage tray may also be a compartment that is molded into the frame where the frame is molded of plastic.

The system may come in a variety of sizes to accommodate different types of mops and/or to change the capacity of the system. Various changes in the configuration and appearance of the components may be made. The components may be made of a variety of materials including molded plastic, metal or the like. The bucket and wringer components may be made from corrosion resistant materials, such as the chemicals used in the cleaning industry, such that the chemicals and water do not corrode or otherwise adversely affect the materials. Olefins such as polypropylene and polyethylene may be used. Plastic materials such as nylon and acetal may be used to resist attack from chemical cleaning solutions. Any metal components that have long term contact with the cleaning agents and water may be made of stainless steel. Some components may be made of steel that is powder coated.

The operation of the clean water mopping system will be described. In a typical use the mop bucket 12 is in the configuration of FIG. 1 and is filled with clean water, the filter bucket 4 may be empty or it may contain a small quantity of clean water. The mop bucket 12 may be filled to a point above the bottom 4*a* of the filter bucket 4 such that some of the water from the mop bucket flows through the drain 14 and into the filter bucket 2 to allow a larger water holding capacity for the system. Assuming that the mop is dry to begin the mopping process, the user dips the dry mop into the water in the mop bucket 12 and fully wets the mop. The user lifts the mop and sets it in the wringer 6 (possibly with a twisting motion for a string mop to easily fit the mop into the wringer) and wrings some of the water out of the mop into the filter bucket 4. The wrung water may begin to pass through the filter 16 and into the drain 14 to flow back to the mop bucket 12 depending upon the amount of water in the filter bucket 4 and the condition and porosity of the filter 16. The user mops the floor with the wet mop to clean the floor until the mop becomes too dirty or too dry. The user may then dip the mop into the water in the mop bucket 12 to rinse the dirt out of the mop, and place the mop in the wringer 6 to wring excess water from the mop into the filter bucket 4. This process may be repeated. As the process is repeated the water in the mop bucket 12 may become increasingly dirty from the rinsing of the mop. However, unlike traditional mop buckets the user has the option of cleaning the water in the mop bucket 12 at any time during the cleaning process such that the user does not have to use dirty water to clean the floor and does not have to return to a janitor's closet to refill the clean water. The water may be cleaned after each rinsing and wringing of the mop or the water may be cleaned after several repetitions of the cleaning process. In any event the user can decide when the water in the mop bucket is too dirty and can clean the water in the mop bucket in a timely fashion at the cleaning site. The water may be cleaned without returning to a janitor's closet or other remote location and without discarding the dirty water and refilling the mop bucket with clean water.

To clean the dirty water, the user tilts the mop bucket 12, as shown in FIG. 2, such that the dirty water drains from the mop bucket 12 into the filter bucket 4. After the water drains from the mop bucket 12, the mop bucket 12 is rotated back to its upright position as shown in FIGS. 1, 3, 4 and 5. If the drain 14 must be disconnected in order to allow for rotation of the mop bucket 12, the drain 14 is disconnected (FIG. 2) from one or both of the mop bucket 12 and filter bucket 4 to rotate and empty the mop bucket 12 and is reconnected when the mop bucket 12 is rotated back to its upright position. At this point the mop bucket 12 is empty and the filter bucket 4 is filled with dirty water. The dirty water flows along the fluid flow path and passes through the filter 16 and drain 14 where it flows to the mop bucket 12. The filter 16 removes the dirt from the water such that the water that is returned to the mop bucket 12 is considered clean water for mopping purposes. Once the mop bucket 12 is filled, or substantially filled, with clean water the user may continue to clean the floor with clean water. The process may be repeated as often as necessary by the user without having to return to a janitor's closet or other remote location and without dumping and refilling the dirty water. At the end of a shift or at another suitable time the water in the system may be completely replaced. The filter 16 may be made removable from the system such that the filter may be cleaned, rinsed, laundered, or the like and a replaced, or the dirty filter may be disposed of and replaced by a new filter.

Figure 6:
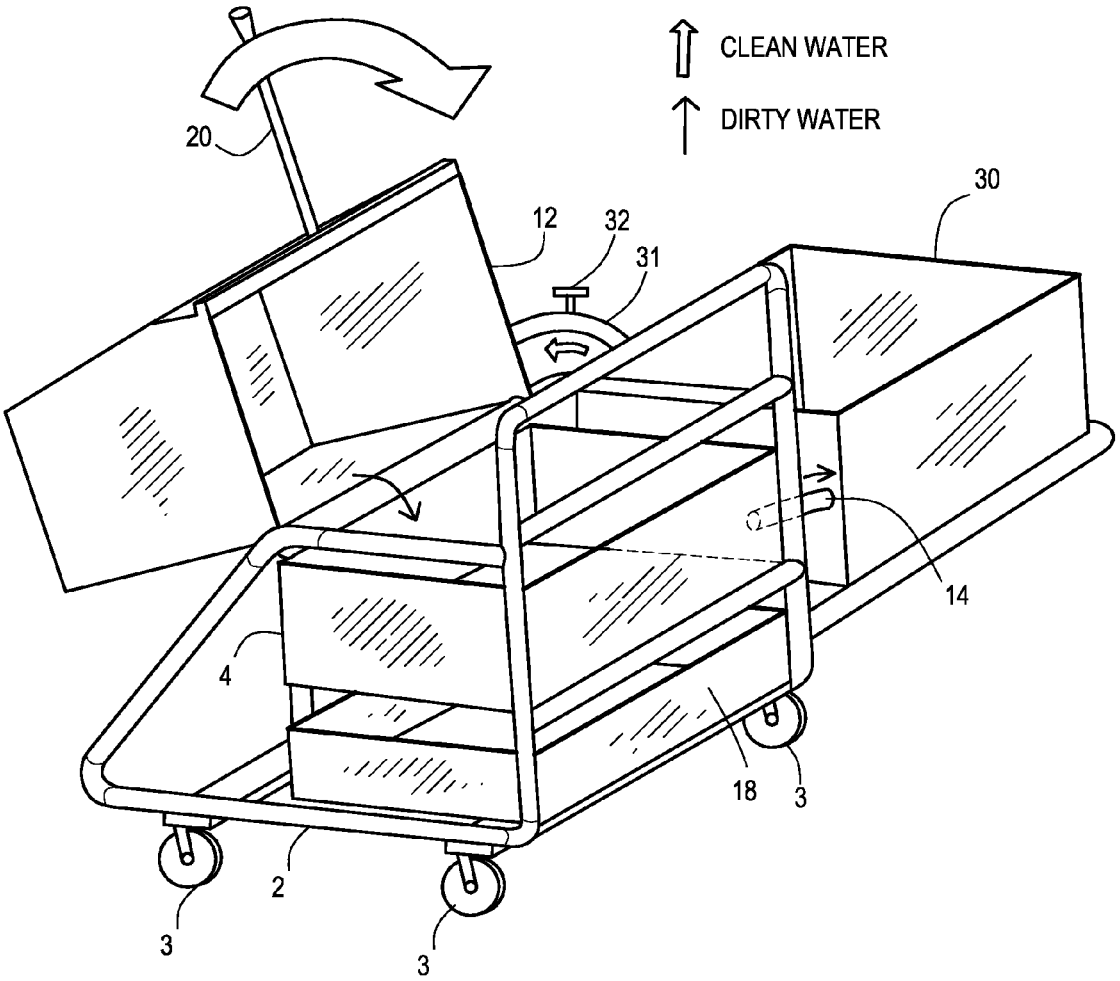
FIG. 6 is a perspective view of still another embodiment of the clean water mopping system of the invention.

Because it takes time for the water to drain from the filter bucket 4 to the mop bucket 12 through the filter 16, in some embodiments a separate clean water reservoir 30 may be provided for holding clean filtered water as shown in FIG. 6. The separate reservoir 30 may be arranged in the fluid flow path between the filter bucket 4 and the mop bucket 12 and may be provided with clean water to start the cleaning process. The filter bucket 2 may be in fluid communication with the reservoir 30 via a conduit or drain 14 and the reservoir 30 may be in fluid communication with the mop bucket 12 via a conduit 31 and valve 32 such that water may flow in a controlled manner from the filter bucket 2 to the mop bucket 12 via the reservoir 30. When it is desired to clean the water in the mop bucket 12, the mop bucket 12 is rotated to drain the dirty water into the filter bucket 4 as previously described. The clean water in the separate clean water reservoir 30 is delivered to the mop bucket 12 immediately upon emptying the mop bucket 12 into the filter bucket 4 by opening valve 32 to allow clean water to flow from the reservoir 30 to the mop bucket 12. When the reservoir 30 is emptied into the mop bucket 12 the valve 32 is closed. The drain 14 from the filter bucket 4 drains the water to the reservoir 30 rather than to the mop bucket 12 to refill the reservoir 30 with clean water. A filter 16 is located in the fluid flow path between the filter bucket 4 and the clean water reservoir 30 as previously described. The user may immediately use the clean water in the mop bucket 12 while the dirty water drains from the filter bucket 4 to the reservoir 30 and is filtered.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A mopping system comprising:

a filter bucket;

a mop wringer mounted such that water from a wet cleaning surface of a mop wrung in the mop wringer drains into the filter bucket;

a mop bucket for receiving a cleaning surface of a mop, the mop bucket being pivotably mounted relative to the filter bucket, such that the mop bucket is pivotable between an upstanding use position and a drain position, in which water in the mop bucket drains into the filter bucket;

a fluid flow path connecting the filter bucket to the mop bucket such that water in the filter bucket will flow through the fluid flow path from the filter bucket to the mop bucket; and a filter located in the fluid flow path, wherein the fluid flow path comprises a fluid outlet in a bottom wall of the filter bucket and a fluid inlet in a side wall of the mop bucket.

2. The mopping system of claim 1 wherein a portion of the mop bucket is moved vertically between the use position and the drain position.

3. The mopping system of claim 1 wherein in the drain position a bottom of the mop bucket is positioned above the filter bucket.

4. The mopping system of claim 1 wherein a lift system is operatively connected to the mop bucket to move the mop bucket between the use position and the drain position.

5. The mopping system of claim 4 wherein the lift system comprises a hinge rotatably supporting the mop bucket and a handle operatively connected to the mop bucket to move the mop bucket between the use position and the drain position.

6. The mopping system of claim 5 wherein the handle is operatively connected to the mop bucket by a hinge.

7. The mopping system of claim 5 wherein the handle is movable relative to the mop bucket between a use position and a storage position.

8. The mopping system of claim 1 wherein the mop bucket and filter bucket are supported on wheels.

9. A mopping system comprising:

a filter bucket;

a mop wringer mounted such that water from a wet cleaning surface of a mop wrung in the mop wringer drains into the filter bucket;

a mop bucket mounted such that the mop bucket is rotatable relative to the filter bucket between a use position, in which the mop bucket is in an upright position for receiving a cleaning surface of a mop, and a drain position, in which the mop bucket is rotated relative to the upright position such that water in the mop bucket may flow to the filter bucket;

a fluid flow path connecting the filter bucket to the mop bucket such that the water may flow from the filter bucket to the mop bucket along the fluid flow path; and a filter located in the fluid flow path such that the water flows through the fluid flow path and the filter, wherein the fluid flow path comprises a fluid outlet in a bottom wall of the filter bucket and a fluid inlet in a side wall of the mop bucket.

10. The mopping system of claim 9 wherein the fluid flow path comprises a drain connecting the filter bucket to the mop bucket, the drain comprising the fluid outlet and the fluid inlet.

11. The mopping system of claim 9 wherein the fluid flow path comprises a reservoir disposed between the filter bucket and the mop bucket.

12. The mopping system of claim 9 wherein a lift system is operatively connected to the mop bucket to move the mop bucket between the use position and the drain position.

13. The mopping system of claim 12 wherein the lift system comprises a handle operatively connected to the mop bucket and a hinge rotatably supporting the mop bucket.

14. A method of operating a mopping system comprising a filter bucket; a mop wringer; a mop bucket rotatably mounted such that the mop bucket is movable between an upstanding use position and a tilted drain position; a fluid flow path connecting the filter bucket to the mop bucket such that water in the filter bucket will drain through the fluid flow path from the filter bucket to the mop bucket; a filter located in the fluid flow path, the method comprising:

wetting a mop in the mop bucket;

wringing excess water from the mop in the mop wringer such that the excess water drains into the filter bucket;

tilting the mop bucket to the drain position such that the dirty water drains from the mop bucket into the filter bucket;

rotating the mop bucket back to the upright use position; and allowing the dirty water to flow along the fluid flow path through the filter and to the mop bucket as filtered water, wherein the fluid flow path comprises a fluid outlet in a bottom wall of the filter bucket and a fluid inlet in a side wall of the mop bucket.

15. The method of claim 14 further comprising removing the filter and selecting from one of cleaning and replacing the filter.

16. The mopping system of claim 11 wherein a valve controls the flow of water from the reservoir to the mop bucket.

17. The mopping system of claim 1 wherein the fluid flow path comprises a drain connecting the filter bucket to the mop bucket, the drain comprising the fluid outlet and the fluid inlet.

18. The mopping system of claim 1 wherein the fluid flow path comprises a reservoir disposed between the filter bucket and the mop bucket.

19. The mopping system of claim 1 wherein the filter bucket is connected to the mop bucket by a fluid flow path, such that water in the filter bucket drains by head pressure through the fluid flow path from the filter bucket to the mop bucket.

20. The mopping system of claim 9 wherein the filter bucket is connected to the mop bucket by a fluid flow path, such that water in the filter bucket drains by head pressure through the fluid flow path from the filter bucket to the mop bucket.

* * * * *